US007866383B2

(12) United States Patent
Dusterhoft et al.

(10) Patent No.: US 7,866,383 B2
(45) **Date of Patent: *Jan. 11, 2011**

(54) SAND CONTROL SCREEN ASSEMBLY AND METHOD FOR USE OF SAME

(75) Inventors: Ronald G. Dusterhoft, Katy, TX (US); Kim Vance Thornton, Houston, TX (US); Carl Bismark Ferguson, La Porte, TX (US); Tommy Frank Grigsby, Katy, TX (US); Floyd Randolph Simonds, Dallas, TX (US); William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 60 days.

This patent is subject to a terminal disclaimer.

(21) Appl. No.: 12/201,655

(22) Filed: Aug. 29, 2008

(65) Prior Publication Data

US 2010/0051270 A1 Mar. 4, 2010

(51) Int. Cl.
*E21B 43/08* (2006.01)
*E21B 43/10* (2006.01)

(52) U.S. Cl. ..... 166/227; 166/381; 166/234

(58) Field of Classification Search ..... 166/100, 166/227, 229, 234, 381
See application file for complete search history.

(56) References Cited

U.S. PATENT DOCUMENTS

| | | | | |
|---|---|---|---|---|
| 921,337 | A | 1/1909 | Archer | |
| 1,811,235 | A | 1/1926 | King | |
| 2,945,541 | A | 7/1960 | Maly et al. | |
| 2,981,333 | A | 4/1961 | Miller et al. | |
| 3,390,724 | A | 7/1968 | Caldwell | |
| 4,585,064 | A | 4/1986 | Graham et al. | |
| 4,670,501 | A | 6/1987 | Dymond et al. | |
| 5,165,478 | A * | 11/1992 | Wilson | 166/297 |
| 5,249,627 | A | 10/1993 | Harms et al. | |
| 5,833,000 | A | 11/1998 | Weaver et al. | |

(Continued)

FOREIGN PATENT DOCUMENTS

EP 1792049 A1 6/2006

(Continued)

OTHER PUBLICATIONS

Dave Allison; Swellable Rubber Technology Joins Cementing; E&P (May 2007).

(Continued)

*Primary Examiner*—Giovanna C Wright
(74) *Attorney, Agent, or Firm*—Lawrence R. Youst

(57) ABSTRACT

A sand control screen assembly (40) is operably positionable within a wellbore (50). The sand control screen assembly (40) includes a base pipe (42) having a plurality of openings (46) in a sidewall portion thereof and an internal flow path (44). A plurality of radially extendable filter members (52) are each operably associated with at least one of the openings (46) of the base pipe (42). The radially extendable filter members (52) have a circumferential dimension that is less than a longitudinal dimension thereof. The radially extendable filter members (52) have a radially retracted running configuration and a radially extended operating configuration, in which, the radially extendable filter members (52) preferably contact the wellbore (50).

36 Claims, 9 Drawing Sheets

U.S. PATENT DOCUMENTS 5,836,392 A 11/1998 Urlwin-Smith
5,839,510 A 11/1998 Weaver et al.
5,853,048 A 12/1998 Weaver et al.
5,874,490 A 2/1999 Arora et al.
5,934,376 A 8/1999 Nguyen et al.
6,003,600 A 12/1999 Nguyen et al.
6,192,986 B1 2/2001 Ulwin-Smith
6,196,317 B1 3/2001 Hardy
6,263,966 B1 7/2001 Haut et al.
6,302,207 B1 10/2001 Nguyen et al.
6,311,773 B1 11/2001 Todd et al.
6,427,775 B1 8/2002 Dusterhoft et al.
6,439,309 B1 8/2002 Matherly et al.
6,446,722 B2 9/2002 Nguyen et al.
6,481,494 B1 11/2002 Dusterhoft et al.
6,457,518 B1 4/2003 Castano-Mears et al.
6,540,022 B2 4/2003 Dusterhoft et al.
6,543,545 B1 4/2003 Chatterji et al.
6,557,635 B2 5/2003 Nguyen et al.
6,571,872 B2 6/2003 Dusterhoft et al.
6,575,245 B2 6/2003 Hurst et al.
6,582,819 B2 6/2003 McDaniel et al.
6,588,507 B2 7/2003 Dusterhoft et al.
6,653,436 B2 11/2003 Back et al.
6,677,426 B2 1/2004 Noro et al.
6,698,519 B2 3/2004 Nguyen et al.
6,702,019 B2 3/2004 Dusterhoft et al.
6,719,051 B2 4/2004 Hailey, Jr. et al.
6,755,245 B2 6/2004 Nguyen et al.
6,766,862 B2 7/2004 Chatterji et al.
6,772,837 B2 8/2004 Dusterhoft et al.
6,854,522 B2 2/2005 Brezinski et al.
6,886,634 B2 5/2005 Richards
6,899,176 B2 5/2005 Hailey, Jr. et al.
6,956,086 B2 10/2005 Back et al.
7,013,979 B2 3/2006 Richard
7,036,587 B2 5/2006 Munoz et al.
7,096,945 B2 8/2006 Richards et al.
7,108,062 B2 9/2006 Castano-Mears et al.
7,108,083 B2 9/2006 Simonds et al.
7,114,560 B2 10/2006 Nguyen et al.
7,131,491 B2 11/2006 Blauch et al.
7,153,575 B2 12/2006 Anderson et al.
7,191,833 B2 3/2007 Richards
7,216,706 B2 5/2007 Echols et al.
7,431,098 B2 7/2007 Ohmer et al.
7,252,142 B2 8/2007 Brezinski et al.
7,258,166 B2 8/2007 Russell
7,264,047 B2 9/2007 Brezinski et al.
7,267,171 B2 9/2007 Dusterhoft et al.
7,299,875 B2 11/2007 Nguyen
7,299,882 B2 11/2007 Brezinski et al.
7,320,367 B2 1/2008 Brezinski et al.
7,520,327 B2 1/2008 Surjaatmadja
7,350,579 B2 4/2008 Clark et al.
7,363,986 B2 4/2008 Brezinski et al.
7,373,991 B2 5/2008 Vaidya et al.
7,387,165 B2 6/2008 Lopez de Cardenas et al.
7,392,847 B2 7/2008 Gatlin
7,404,437 B2 7/2008 Brezinski et al.
7,407,007 B2 9/2008 Moen et al.
7,426,962 B2 9/2008 Moen
7,451,815 B2 11/2008 Hailey
7,493,947 B2 2/2009 Ross
7,511,487 B2 3/2009 Badry et al.
7,703,520 B2 * 4/2010 Dusterhoft ..... 166/278
7,712,529 B2 * 5/2010 Dusterhoft et al. ..... 166/278
2004/0060695 A1 4/2004 Castano-Mears et al.
2004/0134656 A1 7/2004 Richards
2005/0077052 A1 4/2005 Ohmer
2005/0126776 A1 7/2005 Russell
2005/0277554 A1 12/2005 Blauch et al.
2005/0284633 A1 12/2005 Richard
2006/0042801 A1 3/2006 Hackworth et al.
2006/0090903 A1 5/2006 Gano et al.
2006/0108114 A1 5/2006 Johnson
2006/0124310 A1 6/2006 Lopez de Cardenas et al.
2006/0175065 A1 8/2006 Ross
2006/0185849 A1 8/2006 Edwards et al.
2006/0186601 A1 8/2006 Lopez
2007/0012436 A1 1/2007 Freyer
2007/0114018 A1 5/2007 Brezinski et al.
2007/0131422 A1 6/2007 Gatlin et al.
2007/0131434 A1 6/2007 MacDougall et al.
2007/0257405 A1 11/2007 Freyer
2007/0272411 A1 11/2007 Lopez de Cardenas et al.
2008/0006405 A1 1/2008 Rickman et al.
2008/0035349 A1 2/2008 Richard
2008/0078561 A1 4/2008 Chalker et al.
2008/0093086 A1 4/2008 Courville et al.
2008/0125335 A1 5/2008 Bhavsar
2008/0149351 A1 6/2008 Marya et al.
2008/0156492 A1 7/2008 Bosma et al.
2008/0194717 A1 8/2008 Vaidya et al.
2008/0217022 A1 9/2008 Simonds et al.
2008/0283240 A1 11/2008 Baaijens et al.
2009/0173490 A1 7/2009 Dusterhoft et al.
2009/0173497 A1 7/2009 Dusterhoft et al.

FOREIGN PATENT DOCUMENTS

EP 1759086 A1 6/2007
GB 2421527 A 6/2006
WO 9626350 8/1996
WO 03052238 7/2003
WO 2004018836 3/2004
WO 2004022911 3/2004
WO 2005056977 6/2005
WO 2005100743 10/2005
WO 2005124091 12/2005
WO 2006003113 1/2006
WO 2006113500 10/2006
WO 2006003112 12/2006
WO 2007092082 8/2007
WO 2007092083 8/2007
WO 2007126496 11/2007
WO 2008070674 6/2008
WO 2008122809 10/2008
WO 2009001073 12/2008

OTHER PUBLICATIONS

Drew Hembling; Aramco Uses Swell Pakers to Enable Smart Open-Hole, Multilateral Completions for EOR; Completions (Sep./Oct. 2007) (pp. 108-114).
Cleanable Media Products; http://www.purloator-facet.com/media.htm; (Nov. 27, 2007); (pp. 1-3).
Karen Bybee; Swelling Packers Solve Zonal-Isolation Challenge in Oman High-Pressure Wells; HP/HT hallenges article; (Mar. 2007); (pp. 75-79).
Teleperf Technology; Baker Hughes Incorporated; (pp. 1-3) (Undated but admitted prior art).
International Search Report and Written Opinion, International Searching Authority European Patent Office, Aug. 5, 2009.
PCT Search Report and Written Opinion (Oct. 29, 2009).
International Search Report and Written Opinion—PCT/US2009/054957, International Searching Authority, Dec. 12, 2009.

* cited by examiner

SAND CONTROL SCREEN ASSEMBLY AND METHOD FOR USE OF SAME

TECHNICAL FIELD OF THE INVENTION

This invention relates, in general, to controlling the production of particulate materials from a subterranean formation and, in particular, to a sand control screen assembly having radially extendable filter members that are operable to contact the formation upon actuation.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate materials. For example, the particulate materials cause abrasive wear to components within the well, such as tubing, flow control devices and safety devices. In addition, the particulate materials may partially or fully clog the well creating the need for an expensive workover. Also, if the particulate materials are produced to the surface, they must be removed from the hydrocarbon fluids by processing equipment at the surface.

One method for preventing the production of such particulate materials is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material, such as gravel, is then pumped down the work string and into the well annulus formed between the sand control screen and the perforated well casing or open hole production zone.

The liquid carrier either flows into the formation, returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in extended or deviated wellbores including wellbores having long, horizontal production intervals. These incomplete packs are commonly a result of the liquid carrier entering a permeable portion of the production interval causing the gravel to dehydrate and form a sand bridge in the annulus. Thereafter, the sand bridge prevents the slurry from flowing to the remainder of the annulus which, in turn, prevents the placement of sufficient gravel in the remainder of the production interval.

In addition, it has been found that gravel packing is not feasible in certain open hole completions. Attempts have been made to use expandable metal sand control screens in such open hole completions. These expandable metal sand control screens are typically installed in the wellbore then radially expanded using a hydraulic swage or cone that passes through the interior of the screen or other metal forming techniques. In addition to filtering particulate materials out of the formation fluids, one benefit of these expandable sand control screens is the radial support they provide to the formation which helps prevent formation collapse. It has been found, however, that conventional expandable sand control screens do not contact the wall of the wellbore along their entire length as the wellbore profile is not uniform. More specifically, due to the process of drilling the wellbore and heterogeneity of the downhole strata, washouts or other irregularities commonly occur which result in certain locations within the wellbore having larger diameters than other areas or having non circular cross sections. Thus, when the expandable sand control screens are expanded, voids are created between the expandable sand control screens and the irregular areas of the wellbore, which has resulted in incomplete contact between the expandable sand control screens and the wellbore. In addition, with certain conventional expandable sand control screens, the threaded connections are not expandable which creates a very complex profile, at least a portion of which does not contact the wellbore. Further, when conventional expandable sand control screens are expanded, the radial strength of the expanded screens is drastically reduced resulting in little, if any, radial support to the borehole.

Therefore, a need has arisen for a sand control screen assembly that prevents the production of particulate materials from a well that traverses a hydrocarbon bearing subterranean formation without the need for performing a gravel packing operation. A need has also arisen for such a sand control screen assembly that provides radial support to the formation without the need for expanding metal tubulars. Further, a need has arisen for such a sand control screen assembly that is suitable for operation in long, horizontal, open hole completions.

SUMMARY OF THE INVENTION

The present invention disclosed herein comprises a sand control screen assembly that prevents the production of particulate materials from a well that traverses a hydrocarbon bearing subterranean formation or operates as an injection well. The sand control screen assembly of the present invention achieves this result without the need for performing a gravel packing operation. In addition, the sand control screen assembly of the present invention interventionlessly provides radial support to the formation without the need for expanding metal tubulars. Further, the sand control screen assembly of the present invention is suitable for operation in open hole completions in long, horizontal production intervals.

In one aspect, the present invention is directed to a sand control screen assembly that is operable to be positioned within a wellbore. The sand control screen assembly includes a base pipe having at least one opening in a sidewall portion thereof and an internal flow path. A plurality of radially extendable filter members are each operably associated with at least one of the openings of the base pipe. The radially extendable filter members have a circumferential dimension that is less than a longitudinal dimension thereof. The radially extendable filter members also have a radially retracted running configuration and a radially extended operating configuration, in which, the radially extendable filter members are preferably in close proximity to or contact with the wellbore.

In one embodiment, a swellable material layer is disposed between the base pipe and at least a portion of the radially extendable filter members such that, in response to contact with an activating fluid, radial expansion of the swellable material layer causes the radially extendable filter members to operate from their running configuration to their operating configuration. In this embodiment, the activating fluid may be a hydrocarbon fluid, water, gas or the like.

In one embodiment, the radially extendable filter members include a cylinder that is coupled to the base pipe and a radially telescoping piston slidably received within the cylinder. In certain embodiments, the radially extendable filter members include a filter retainer and filter medium. In other embodiments, the radially extendable filter members include a perforated tubular. The filter medium associated with the radially extendable filter members may be any one or more of a single layer mesh screen, a multiple layer mesh screen, a wire wrapped screen, a prepack screen, a ceramic screen, metallic or ceramic balls or beads the are sintered or unsintered, a fluid porous, particulate resistant sintered wire mesh screen and a fluid porous, particulate resistant diffusion bonded wire mesh screen.

In one embodiment, the ratio between the circumferential dimension and the longitudinal dimension of the radially extendable filter members is at least 1 to 2. In another embodiment, the ratio between the circumferential dimension and the longitudinal dimension of the radially extendable filter members is between about 1 to 2 and about 1 to 10. In a further embodiment, the ratio between the circumferential dimension and the longitudinal dimension of the radially extendable filter members is between about 1 to 10 and about 1 to 30.

In some embodiments, a fluid flow control device is operably associated with each of the radially extendable filter members. In other embodiments, a fluid flow control device may be operably associated with a plurality of the radially extendable filter members.

In another aspect, the present invention is directed to a sand control screen assembly that is operable to be positioned within a wellbore. The sand control screen assembly includes a base pipe having a plurality of openings in a sidewall portion thereof and an internal flow path. A plurality of radially extendable filter members are each operably associated with at least one of the openings of the base pipe. The radially extendable filter members have a circumferential dimension that is less than a longitudinal dimension thereof. A swellable material layer is disposed exteriorly of the base pipe, such that, in response to contact with an activating fluid, radial expansion of the swellable material layer causes at least a portion of the radially extendable filter members to be displaced toward and preferably in close proximity or contact with a surface of the wellbore.

In a further aspect, the present invention is directed to a method of installing a sand control screen assembly in a wellbore. The method includes running the sand control screen assembly to a target location within the wellbore, the sand control screen assembly including a plurality of radially extendable filter members each of which is operably associated with at least one opening of a base pipe, the radially extendable filter members having a circumferential dimension that is less than a longitudinal dimension thereof and operating the radially extendable filter members from a radially retracted running configuration to a radially extended operating configuration.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1A:
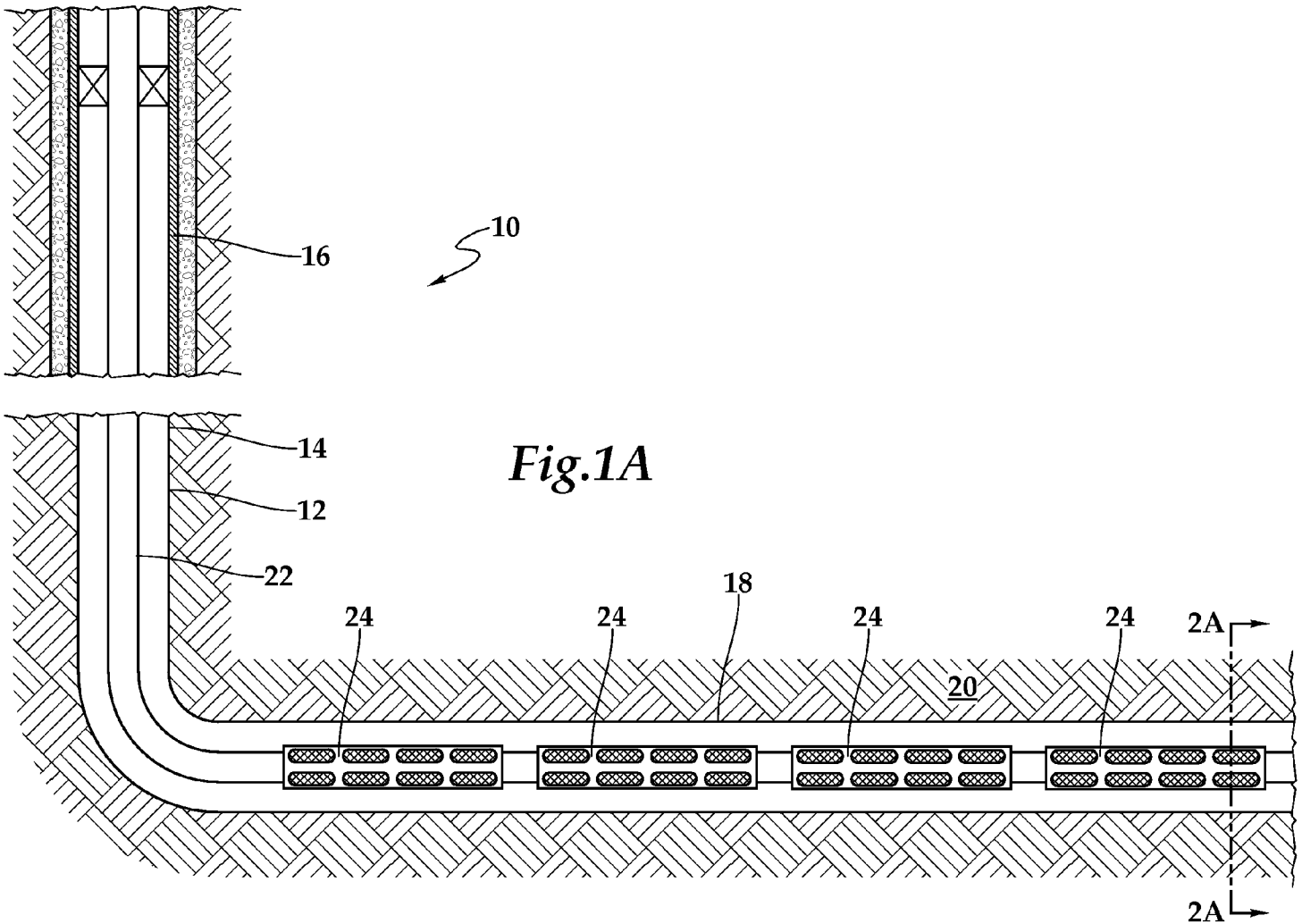
FIG. 1A is a schematic illustration of a well system operating a plurality of sand control screen assemblies in their running configuration according to an embodiment of the present invention.

Referring initially to FIG. 1A, therein is depicted a well system including a plurality of sand control screen assemblies embodying principles of the present invention that is schematically illustrated and generally designated 10. In the illustrated embodiment, a wellbore 12 extends through the various earth strata. Wellbore 12 has a substantially vertical section 14, the upper portion of which has installed therein a casing string 16 that is cemented within wellbore 12. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. Positioned within tubing string 22 is a plurality of sand control screen assemblies 24. The sand control screen assemblies 24 are shown in a running or unextended configuration.

Figure 1B:
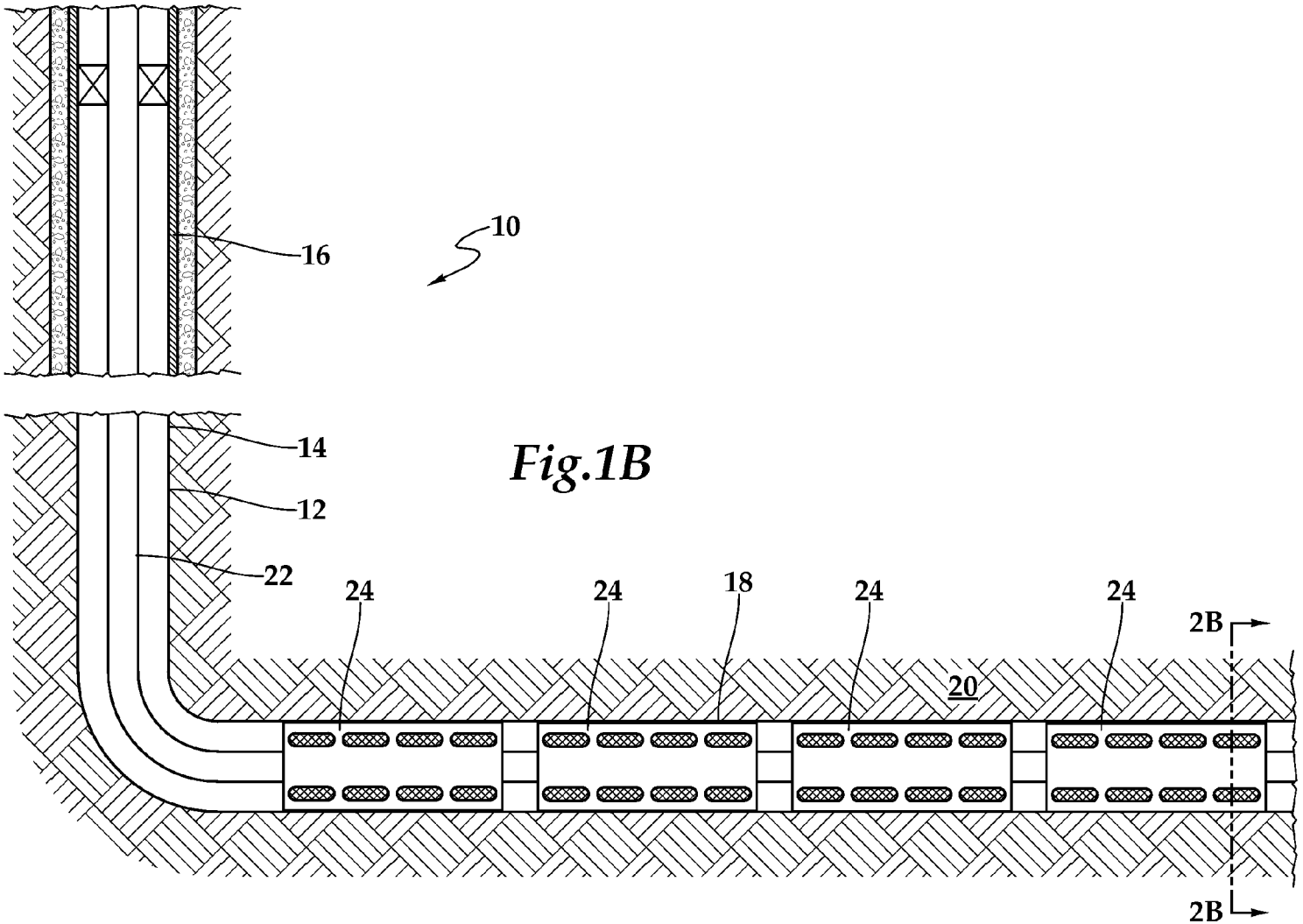
FIG. 1B is a schematic illustration of a well system operating a plurality of sand control screen assemblies in their operating configuration according to an embodiment of the present invention.

Referring also to FIG. 1B, therein is depicted the well system of FIG. 1A with sand control screen assemblies 24 in their operating or radially expanded configuration. As explained in greater detail below, each of the depicted sand control screen assemblies 24 has a base pipe, a plurality of radially extendable filter members and a swellable material layer. In general, the swellable material layer is disposed exteriorly around the base pipe and the radially extendable filter members are disposed externally of the swellable material layer. In this configuration, when sand control screen assemblies 24 come in contact with an activating fluid, such as a hydrocarbon fluid, water or a gas, the swellable material layer of each sand control screen assembly 24 radially expands which in turn causes the radially extendable filter members of sand control screen assemblies 24 to contact the surface of wellbore 12.

Even though FIGS. 1A-1B, depict tubing string 22 as including only sand control screen assemblies 24, those skilled in the art will recognize that tubing string 22 may include any number of other tools and systems such as fluid flow control devices, communication systems, safety systems and the like. Also, tubing string 22 may be divided into a plurality of intervals using zonal isolation devices such as packers. Similar to the swellable material in sand control screen assemblies 24, these zonal isolation devices may be made from materials that swell upon contact with a fluid, such as an inorganic or organic fluid. Some exemplary fluids that may cause the zonal isolation devices to swell and isolate include water, gas and hydrocarbons.

In addition, even though FIGS. 1A-1B depict the sand control screen assemblies of the present invention in a horizontal section of the wellbore, it should be understood by those skilled in the art that the sand control screen assemblies of the present invention are equally well suited for use in deviated or vertical wellbores. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Likewise, even though FIGS. 1A-1B depict the sand control screen assemblies of the present invention in a wellbore having a single borehole, it should be understood by those skilled in the art that the sand control screen assemblies of the present invention are equally well suited for use in multilateral wellbores having a main wellbore and a plurality of branch wellbores.

Figure 2A:
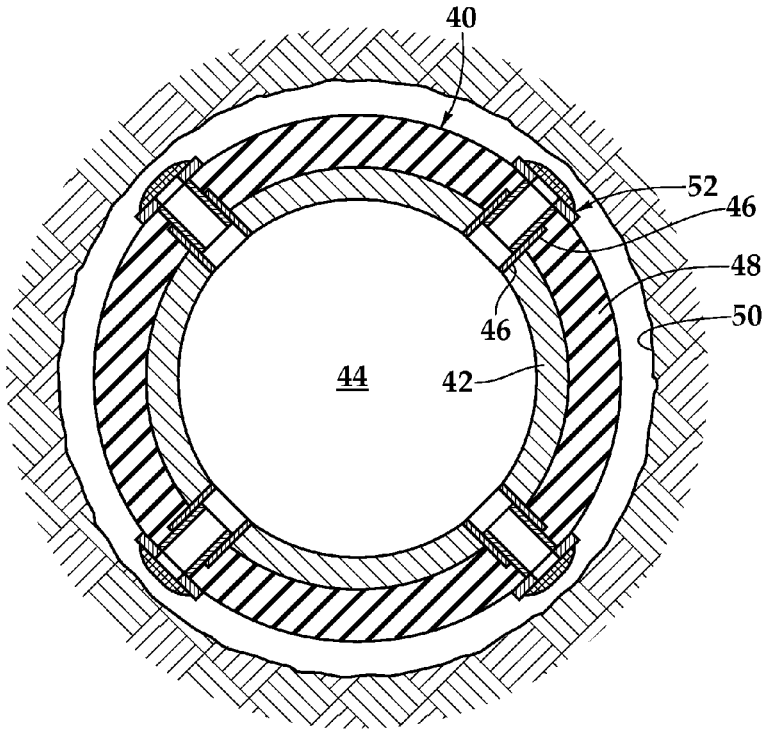
FIG. 2A is a cross sectional view taken along line 2A-2A of a sand control screen assembly of FIG. 1A in a running configuration according to an embodiment of the present invention.
Figure 3A:
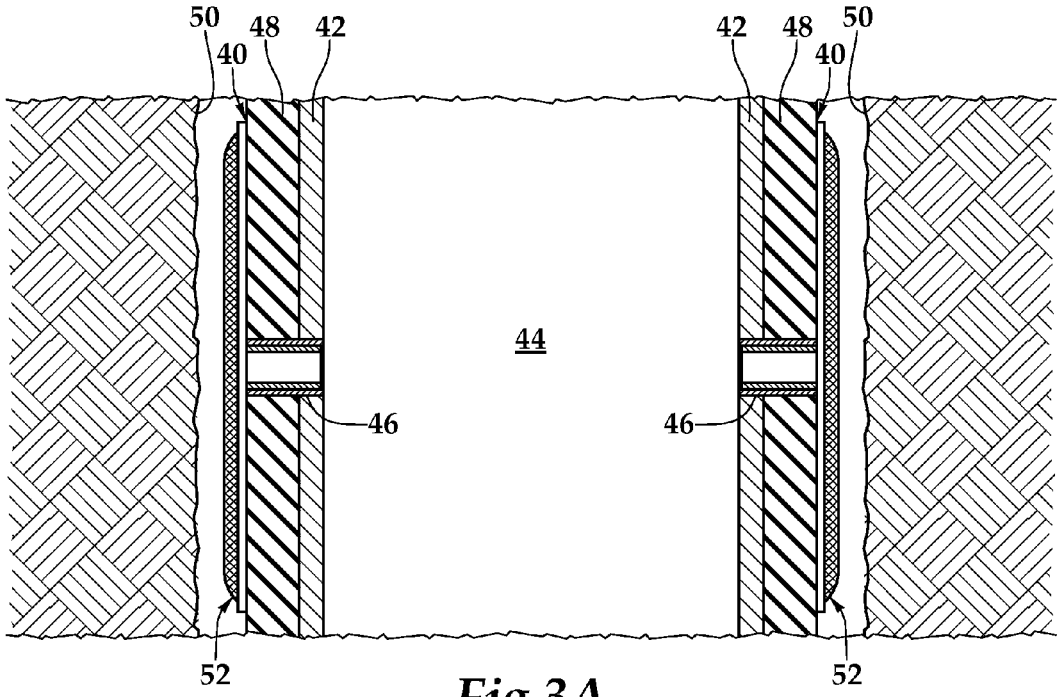
FIG. 3A is a cross sectional of a sand control screen assembly in a running configuration according to an embodiment of the present invention.

Referring to FIGS. 2A and 3A, therein are depicted cross sectional views of a sand control screen assembly in its running configuration that embodies principles of the present invention and is generally designated 40. Sand control screen assembly 40 includes base pipe 42 that defines an internal flow path 44. Base pipe 42 has a plurality of openings 46. Positioned around base pipe 42 is a swellable material layer 48. Swellable material layer 48 is attached to base pipe 42 by bonding or other suitable technique. Preferably, the thickness of swellable material layer 48 is optimized based upon the diameter of sand control screen assembly 40 and the diameter of wellbore 50 such that upon expansion, as explained in greater detail below, substantially uniform contact between both swellable material layer 48 and radially extendable filter members 52 with the surface of wellbore 50 is achieved. Preferably, radially extendable filter members 52 are circumferentially and longitudinally distributed about sand control screen assembly 40 and provide a plurality of substantially direct pathways for production fluids from the formation to enter internal flow path 44 of base pipe 42.

Figure 4C:
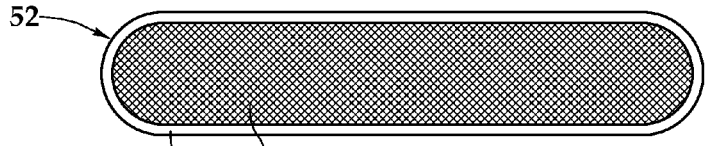
FIG. 4C is a top view of a radially extendable filter member for use in a sand control screen assembly according to an embodiment of the present invention.
Figure 4A:
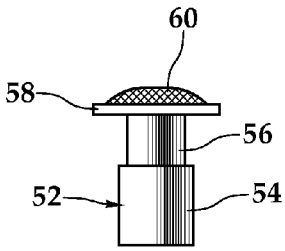
FIG. 4A is a side view of a radially extendable filter member for use in a sand control screen assembly according to an embodiment of the present invention.
Figure 4B:
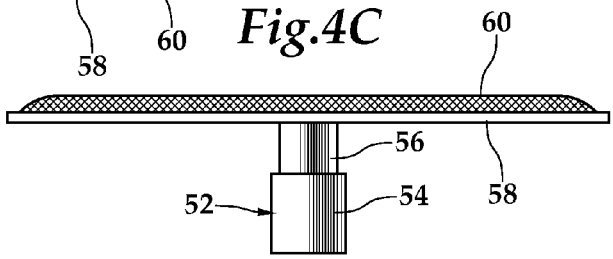
FIG. 4B is a front view of a radially extendable filter member for use in a sand control screen assembly according to an embodiment of the present invention.

In the illustrated embodiment and as best seen in FIGS. 4A-4C, radially extendable filter members 52 each includes a cylinder 54 that is attached to base pipe 42 by threading, welding, friction fit or other suitable technique. Slidably positioned within cylinder 54 is a radially telescoping piston 56. Attached to the outer surface of piston 56 is a filter retainer 58. Filter retainer 58 supports a filter medium 60. Filter medium 60 may comprise a mechanical screening element such as a fluid-porous, particulate restricting, metal screen having one or more layers of woven wire or fiber mesh that may be diffusion bonded or sintered together to form a screen designed to allow fluid flow therethrough but prevent the flow of particulate materials of a predetermined size from passing therethrough. In the illustrated embodiment, filter medium 60 includes outer and inner drainage layers that have a relatively course wire mesh with a filtration layer disposed therebetween having a relatively fine mesh. It should be noted that other types of filter media may be used with the sand control screen assemblies of the present invention, such as a wire screen, a prepack screen, a ceramic screen, metallic beads such as stainless steel beads or sintered stainless steel beads and the like. Filter medium 60 is sized according to the particular requirements of the production zone into which it will be installed. Some exemplary sizes of the gaps in filter medium 60 may be in the 20-250 standard mesh range.

Figure 2B:
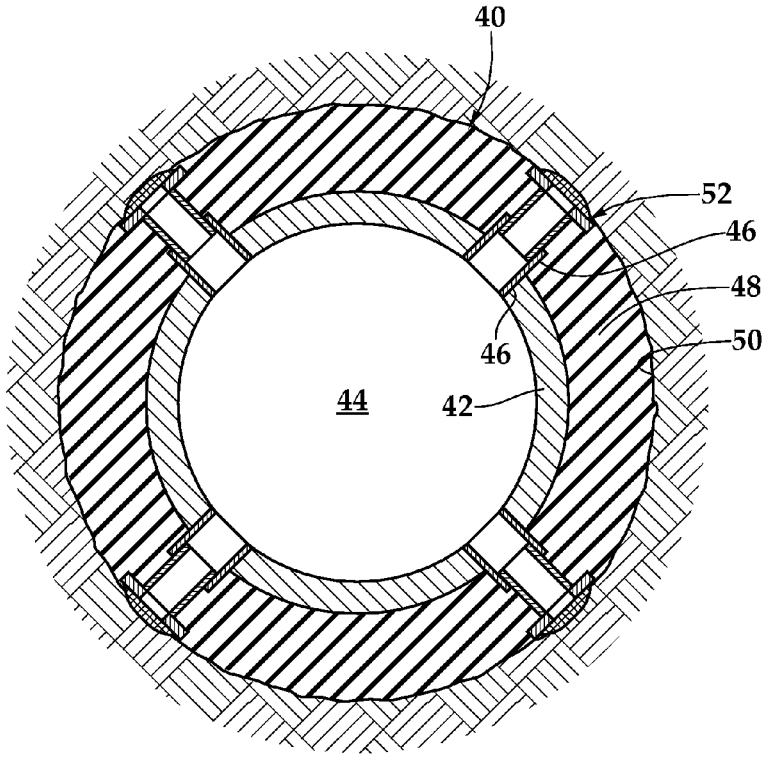
FIG. 2B is a cross sectional view taken along line 2B-2B of a sand control screen assembly of FIG. 1B in an operating configuration according to an embodiment of the present invention.
Figure 3B:
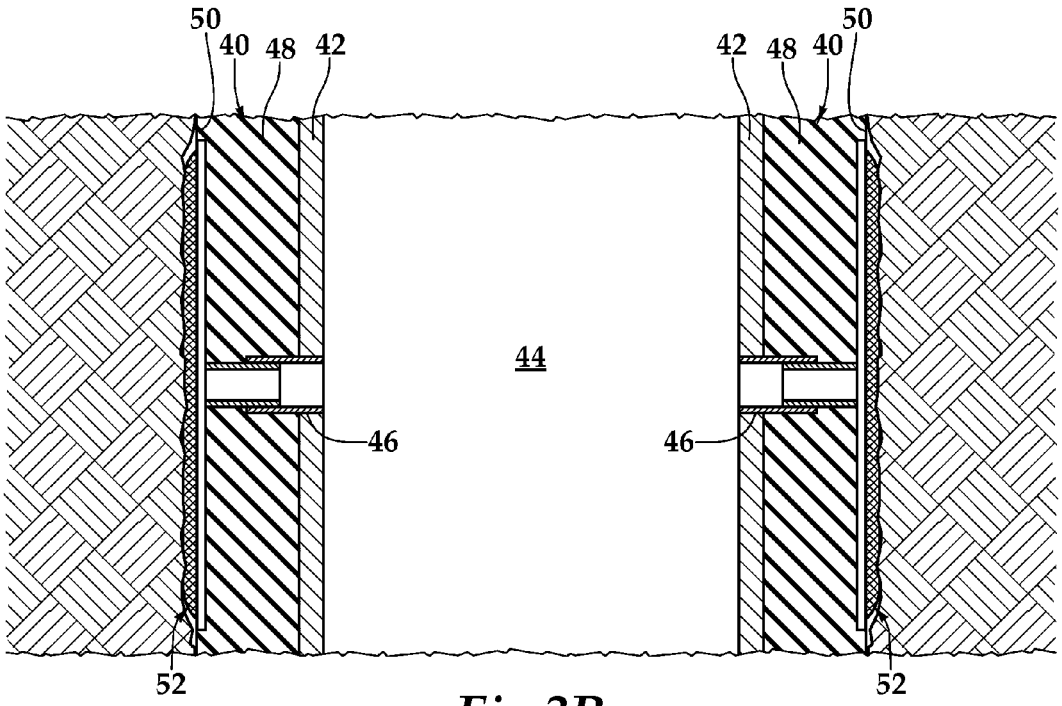
FIG. 3B is a cross sectional of a sand control screen assembly in an operating configuration according to an embodiment of the present invention.

Referring additionally now to FIGS. 2B and 3B, therein are depicted cross sectional views of sand control screen assembly 40 in its operating configuration. In the illustrated embodiment, swellable material layer 48 has come in contact with an activating fluid, such as a hydrocarbon fluid, water or gas, which has caused swellable material layer 48 to radially expand into contact with the surface of wellbore 50, which, in the illustrated embodiment, is the formation face. In addition, the radial expansion of swellable material layer 48 has caused radially extendable filter members 52 to come into contact with the surface of wellbore 50.

One benefit provided by the sand control screen assemblies of the present invention is that in addition to providing a plurality of paths for formation fluids to enter internal flow path 44 and filtering particulate materials out of the formation fluids, the sand control screen assemblies of the present invention also provide support to the formation to prevent formation collapse. Compared with convention expandable metal sand control screens as discussed above, the sand control screen assemblies of the present invention provide improved contact with the formation as greater radial expansion is achievable and the swellable material layer is more compliant such that it is better able to conform to a nonuniform wellbore face. In a preferred implementation, the sand control screen assemblies of the present invention provide between about 500 psi and 2000 psi of collapse support to the wellbore. Those skilled in the art will recognize that the collapse support provided by the present invention can be optimized for a particular implementation though specific design features of the base pipe and the swellable material layer.

Various techniques may be used for contacting swellable material layer 48 with an appropriate activating fluid for causing swelling of swellable material layer 48. For example, the activating fluid may already be present in the well when sand control screen assembly 40 is installed in the well, in which case swellable material layer 48 preferably includes a mechanism for delaying the swelling of swellable material layer 48 such as an absorption delaying or preventing coating or membrane, swelling delayed material compositions or the like.

Alternatively, the activating fluid may be circulated through the well to swellable material layer 48 after sand control screen assembly 40 is installed in the well. As another alternative, the activating fluid may be produced into the wellbore from the formation surrounding the wellbore. Thus, it will be appreciated that any method may be used for causing swelling of swellable material layer 48 of sand control screen assembly 40 in keeping with the principles of the invention.

Swellable material layer 48 is formed from one or more materials that swell when contacted by an activation fluid such as an inorganic or organic fluid. For example, the material may be a polymer that swells multiple times its initial size upon activation by an activation fluid that stimulates the material to expand. In one embodiment, the swellable material is a material that swells upon contact with and/or absorption of a hydrocarbon, such as an oil or a gas. The hydrocarbon is absorbed into the swellable material such that the volume of the swellable material increases creating a radial expansion of the swellable material. Preferably, the swellable material will swell until its outer surface and radially extendable filter members 52 contact the formation face in an open hole completion or the casing wall in a cased wellbore. The swellable material accordingly provides the energy to radially extend radially extendable filter members 52 in contact with the formation.

Some exemplary swellable materials include elastic polymers, such as EPDM rubber, styrene butadiene, natural rubber, ethylene propylene monomer rubber, ethylene propylene diene monomer rubber, ethylene vinyl acetate rubber, hydrogenized acrylonitrile butadiene rubber, acrylonitrile butadiene rubber, isoprene rubber, chloroprene rubber and polynorbornene. These and other swellable materials swell in contact with and by absorption of hydrocarbons so that the swellable materials expand. In one embodiment, the rubber of the swellable materials may also have other materials dissolved in or in mechanical mixture therewith, such as fibers of cellulose. Additional options may be rubber in mechanical mixture with polyvinyl chloride, methyl methacrylate, acrylonitrile, ethylacetate or other polymers that expand in contact with oil.

In another embodiment, the swellable material is a material that swells upon contact with water. In this case, the swellable material may be a water-swellable polymer such as a water-swellable elastomer or water-swellable rubber. More specifically, the swellable material may be a water-swellable hydrophobic polymer or water-swellable hydrophobic copolymer and preferably a water-swellable hydrophobic porous copolymer. Other polymers useful in accordance with the present invention can be prepared from a variety of hydrophilic monomers and hydrophobically modified hydrophilic monomers. Examples of particularly suitable hydrophilic monomers which can be utilized include, but are not limited to, acrylamide, 2-acrylamido-2-methyl propane sulfonic acid, N,N-dimethylacrylamide, vinyl pyrrolidone, dimethylaminoethyl methacrylate, acrylic acid, trimethylammoniumethyl methacrylate chloride, dimethylaminopropylmethacrylamide, methacrylamide and hydroxyethyl acrylate.

A variety of hydrophobically modified hydrophilic monomers can also be utilized to form the polymers useful in accordance with this invention. Particularly suitable hydrophobically modified hydrophilic monomers include, but are not limited to, alkyl acrylates, alkyl methacrylates, alkyl acrylamides and alkyl methacrylamides wherein the alkyl radicals have from about 4 to about 22 carbon atoms, alkyl dimethylammoniumethyl methacrylate bromide, alkyl dimethylammoniumethyl methacrylate chloride and alkyl dimethylammoniumethyl methacrylate iodide wherein the alkyl radicals have from about 4 to about 22 carbon atoms and alkyl dimethylammonium-propylmethacrylamide bromide, alkyl dimethylammonium propylmethacrylamide chloride and alkyl dimethylammonium-propylmethacrylamide iodide wherein the alkyl groups have from about 4 to about 22 carbon atoms.

Polymers which are useful in accordance with the present invention can be prepared by polymerizing any one or more of the described hydrophilic monomers with any one or more of the described hydrophobically modified hydrophilic monomers. The polymerization reaction can be performed in various ways that are known to those skilled in the art, such as those described in U.S. Pat. No. 6,476,169 which is hereby incorporated by reference for all purposes.

Suitable polymers may have estimated molecular weights in the range of from about 100,000 to about 10,000,000 and preferably in the range of from about 250,000 to about 3,000,000 and may have mole ratios of the hydrophilic monomer(s) to the hydrophobically modified hydrophilic monomer(s) in the range of from about 99.98:0.02 to about 90:10.

Other polymers useful in accordance with the present invention include hydrophobically modified polymers, hydrophobically modified water-soluble polymers and hydrophobically modified copolymers thereof. Particularly suitable hydrophobically modified polymers include, but are not limited to, hydrophobically modified polydimethylaminoethyl methacrylate, hydrophobically modified polyacrylamide and hydrophobically modified copolymers of dimethylaminoethyl methacrylate and vinyl pyrollidone.

As another example, the swellable material may be a salt polymer such as polyacrylamide or modified crosslinked poly (meth)acrylate that has the tendency to attract water from salt water through osmosis wherein water flows from an area of low salt concentration, the formation water, to an area of high salt concentration, the salt polymer, across a semi permeable membrane, the interface between the polymer and the production fluids, that allows water molecules to pass therethrough but prevents the passage of dissolved salts therethrough.

In the illustrated embodiment, radially extendable filter members 52 have been designed to be compliant with the surface of the wellbore. Specifically, radially extendable filter members 52 have a relatively narrow circumferential dimension and a relatively extended longitudinal dimension, as best seen in the comparison of FIGS. 2A-2B to FIGS. 3A-3B. In certain embodiments, the ratio between the circumferential dimension and the longitudinal dimension of radially extendable filter members 52 is between about 1 to 2 and about 1 to 10. In other embodiments, the ratio between the circumferential dimension and the longitudinal dimension of radially extendable filter members 52 is between about 1 to 10 and about 1 to 30.

In addition, extendable filter members 52 provide a relatively large interface contact area with the formation. Having this large interface contact area reduces the localized draw down associated with production into the wellbore as compared to fluid inlets having relatively small points of entry, thereby reducing the risk of coning of an unwanted fluid such as water or gas in an oil production operation. Having a relatively large interface contact area compared to the fluid discharge area of individual radially extendable filter members 52 or collections of radially extendable filter members 52 further reduces localized drawdown, as explained in greater detail below.

Figure 5A:
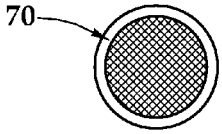
FIG. 5A is a top view of a radially extendable filter member for use in a sand control screen assembly according to an embodiment of the present invention.
Figure 5B:
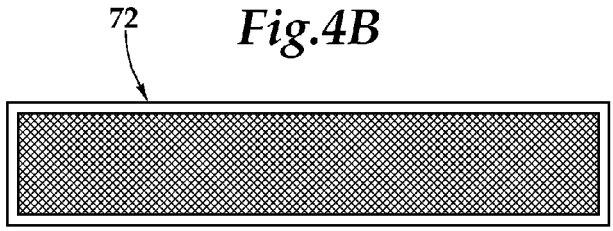
FIG. 5B is a top view of a radially extendable filter member for use in a sand control screen assembly according to an embodiment of the present invention.
Figure 6A:
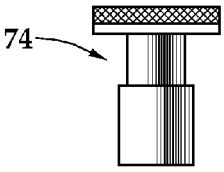
FIG. 6A is a side view of a radially extendable filter member for use in a sand control screen assembly according to an embodiment of the present invention.
Figure 6B:
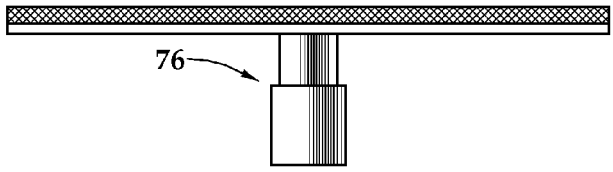
FIG. 6B is a front view of a radially extendable filter member for use in a sand control screen assembly according to an embodiment of the present invention.
Figure 6C:
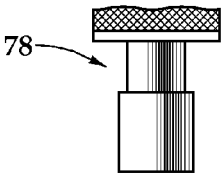
FIG. 6C is a side view of a radially extendable filter member for use in a sand control screen assembly according to an embodiment of the present invention.
Figure 6D:
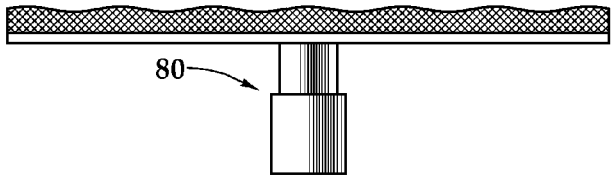
FIG. 6D is a front view of a radially extendable filter member for use in a sand control screen assembly according to an embodiment of the present invention.

Even though radially extendable filter members 52 have been depicted as having a particular cross sectional shape, it should be understood by those skilled in the art that the radially extendable filter members of the present invention could alternatively have cross sections of different shapes including circles, such as radially extendable filter member 70 of FIG. 5A, rectangles, such as radially extendable filter member 72 of FIG. 5B, and other shapes such as ovals, squares, diamonds and the like as well as other non symmetric cross sections, all such shapes being considered within the scope of the present invention. Also, even though radially extendable filter members 52 have been depicted as having a contoured outer surface, it should be understood by those skilled in the art that the radially extendable filter members of the present invention could alternatively have an outer surface having a different configuration including a relatively flat outer surface, such as radially extendable filter members 74, 76 of FIGS. 6A-6B, a non uniform outer surface, such as radially extendable filter member 78, 80 of FIGS. 6C-6D, or the like.

Figure 7A:
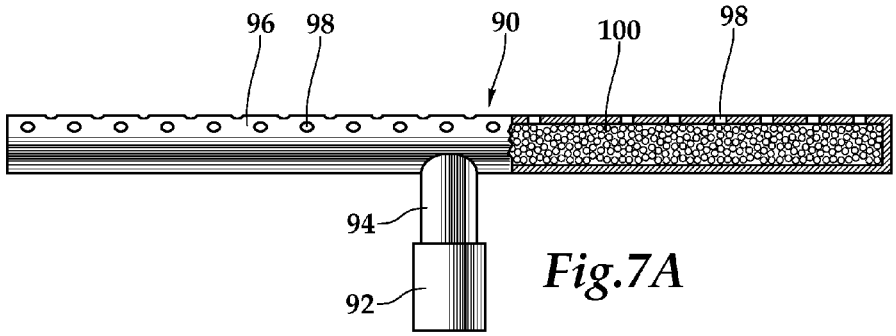
FIG. 7A is a front view of a radially extendable filter member for use in a sand control screen assembly according to an embodiment of the present invention.

Even though radially extendable filter members 52 have been described as having a filter medium attached to a filter retainer, those skilled in the art will recognize that other types of radially extendable filter members could alternatively be used. For example, as best seen in FIG. 7A, radially extendable filter member 90 includes a cylinder 92 that is attached to a base pipe by threading, welding, friction fit or other suitable technique. Slidably positioned within cylinder 92 is a radially telescoping piston 94. Extending longitudinally from piston 94 is a tubular member 96 having a plurality of perforations 98. Disposed within tubular member 96 is a filter medium 100 that is depicted as steel or ceramic balls or beads that may be sintered within tubular member 96. Alternatively, the filter medium could be a single or multiple layer sintered or unsintered mesh, prepacked or resin coated sand, combinations of the above and the like.

Figure 7B:
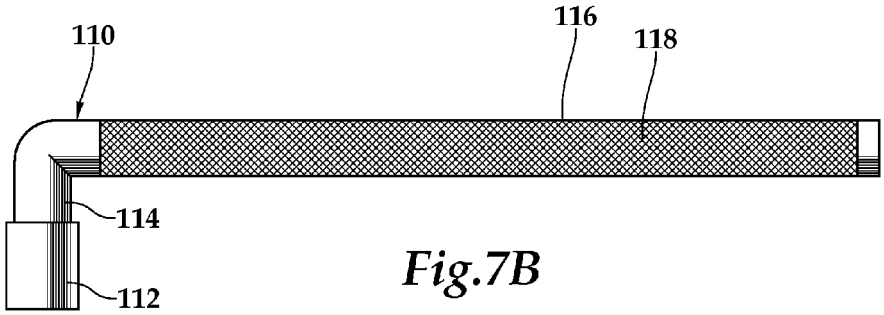
FIG. 7B is a front view of a radially extendable filter member for use in a sand control screen assembly according to an embodiment of the present invention.
Figure 7C:
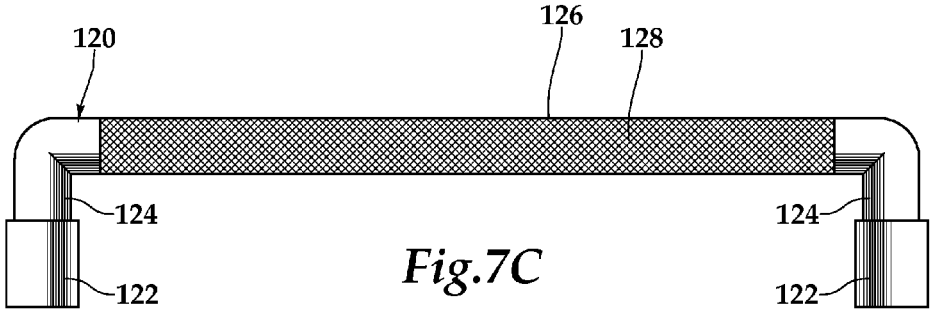
FIG. 7C is a front view of a radially extendable filter member for use in a sand control screen assembly according to an embodiment of the present invention.
Figure 7D:
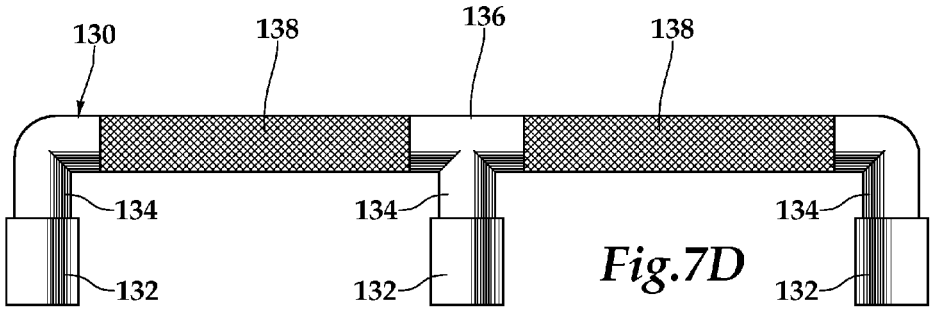
FIG. 7D is a front view of a radially extendable filter member for use in a sand control screen assembly according to an embodiment of the present invention.

Additionally, even though radially extendable filter member 90 has been described as having tubular members in the shape of a "T", those skilled in the art will recognize that other tubular configurations could alternatively be used and would be considered within the scope of the present invention. For example, as best seen in FIG. 7B, radially extendable filter member 110 is formed in the shape of an "L". Specifically, radially extendable filter member 110 includes a cylinder 112 that is attached to a base pipe by threading, welding, friction fit or other suitable technique. Slidably positioned within cylinder 112 is a radially telescoping piston 114. Extending longitudinally from piston 114 is a tubular member 116 having a plurality of perforations that are covered by a suitable filter medium 118. Likewise, as best seen in FIG. 7C, radially extendable filter member 120 is formed in the shape of a "U". Specifically, radially extendable filter member 120 includes a pair of cylinders 122 that are attached to a base pipe by threading, welding, friction fit or other suitable technique. Slidably positioned within cylinders 122 are a pair of radially telescoping pistons 124. Extending longitudinally between pistons 124 is a tubular member 126 having a plurality of perforations that are covered by a suitable filter medium 128. Further, as best seen in FIG. 7D, radially extendable filter member 130 is formed in the shape of an "M". Specifically, radially extendable filter member 130 includes three cylinders 132 that are attached to a base pipe by threading, welding, friction fit or other suitable technique. Slidably positioned within cylinders 132 are three radially telescoping pistons 134. Extending longitudinally between pistons 134 is a tubular member 136 having a plurality of perforations that are covered by a pair of suitable filter media 138. Accordingly, it can be seen that radially extendable filter members that provide one or more direct paths for formation fluids to enter an internal flow path of a base pipe can take many shapes or configurations, each of which are considered to be within the scope of the present invention.

Referring again to FIGS. 2A-4B, in certain embodiments, the outer layer of filter medium 60 may primarily serve as a drainage layer to allow formations fluids to travel annularly or longitudinally within filter medium 60. Likewise, the outer layer of filter medium 60 may also serve as a carrier for a chemical treatment or other agent. The use of this configuration is beneficial, for example, if a filter cake has previously formed on the surface of the formation, then the stand off provided by the outer drainage layer will prevent damage to filtration layers within filter medium 60 and allow removal of the filter cake using acid or other reactive substance.

In one embodiment, the outer layer of filter medium 60 may have the reactive substance impregnated therein. For example, the reactive substance may fill the voids in the outer layer of filter medium 60 during installation. Preferably, the reactive substance is degradable when exposed to a subterranean well environment. More preferably, the reactive substance degrades when exposed to water at an elevated temperature in a well. Most preferably, the reactive substance is provided as described in U.S. Pat. No. 7,036,587 which is hereby incorporated by reference for all purposes.

In certain embodiments, the reactive substance includes a degradable polymer. Suitable examples of degradable polymers that may be used in accordance with the present invention include polysaccharides such as dextran or cellulose, chitins, chitosans, proteins, aliphatic polyesters, poly(lactides), poly(glycolides), poly(ϵ-caprolactones), poly(anhydrides), poly(hydroxybutyrates), aliphatic polycarbonates, poly(orthoesters), poly(amino acids), poly(ethylene oxides), and polyphosphazenes. Of these suitable polymers, aliphatic polyesters such as poly(lactide) or poly(lactic acid) and polyanhydrides are preferred.

The reactive substance may degrade in the presence of a hydrated organic or inorganic compound solid, which may be included in sand control screen assembly 40, so that a source of water is available in the well when the screens are installed. Alternatively, another water source may be delivered to the reactive substance after sand control screen assembly 40 is conveyed into the well, such as by circulating the water source down to the well or formation water may be used as the water source.

Figure 8A:
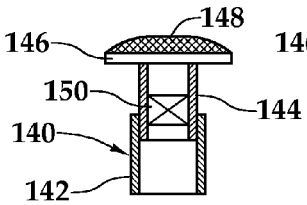
FIG. 8A is a side view of a radially extendable filter member for use in a sand control screen assembly according to an embodiment of the present invention.
Figure 8B:
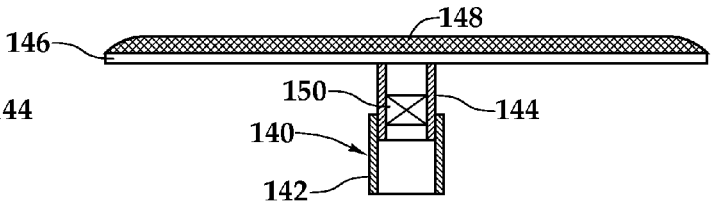
FIG. 8B is a front view of a radially extendable filter member for use in a sand control screen assembly according to an embodiment of the present invention.

Referring next to FIGS. 8A-8B, therein are depicted side and front views, partially in cross section, of a radially extendable filter member for use in a sand control screen assembly that embodies principles of the present invention and is generally designated 140. Radially extendable filter member 140 includes a cylinder 142 that is attached to a base pipe by a suitable technique such as those discussed herein. Slidably positioned within cylinder 142 is a radially telescoping piston 144. Attached to the outer surface of piston 144 is a filter retainer 146. Filter retainer 146 supports a filter medium 148. Filter medium 148 may comprise a mechanical screening element such as those discussed herein. As discussed above, the large interface contact area provided by filter medium 148 reduces the localized draw down associated with production into the wellbore as compared to production into a relatively small point of entry. This benefit is enhanced by a relatively large ratio between the interface contact area of filter medium 148 and the formation and the fluid discharge area of radially extendable filter member 148. A large ratio can be achieved by providing a relatively narrow or restrictive exit path for fluids traveling through radially extendable filter member 148. The ratio may be optimized by positioning a fluid flow control device 150 within the exit path of filter medium 148 such as cylinder 142 or piston 144, as illustrated. In this embodiment, fluid flow control device 150 is used to control the rate of production through radially extendable filter member 148. For example, fluid flow control device 150 may take the form of an inflow control device such as a nozzle, a flow tube, an orifice or other flow restrictor.

Alternatively, depending upon the desired operation, fluid flow control device 150 may take a variety of other forms. For example, it may be desirable to temporarily prevent fluid flow through radially extendable filter member 148. In this case, fluid flow control device 150 may be a dissolvable, removable or shearable plug formed from sand, salt, wax, aluminum, zinc or the like or may be a pressure activated device such as burst disk. As another example, it may be desirable to prevent fluid loss into the formation during high pressure operations internal to the sand control screen assembly including radially extendable filter member 148, in which case, fluid flow control device 150 may be a one-way valve or a check valve. As yet another example, it may be desirable to control the type of fluid entering the sand control screen assembly including radially extendable filter member 148, in which case, fluid flow control device 150 may be a production control device such as a valve that closes responsive to contact with an undesired fluid, such as water. Such valves may be actuated by a swellable material including those discussed above, organic fibers, an osmotic cell or the like.

Figure 9A:
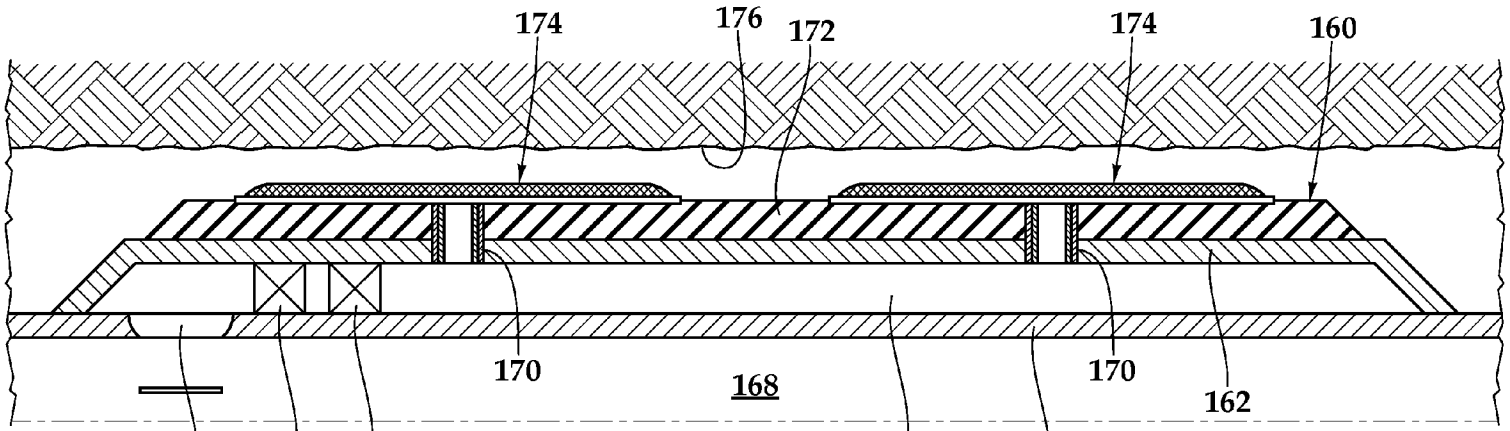
FIG. 9A is a cross sectional view of a sand control screen assembly in a running configuration according to an embodiment of the present invention.
Figure 9B:
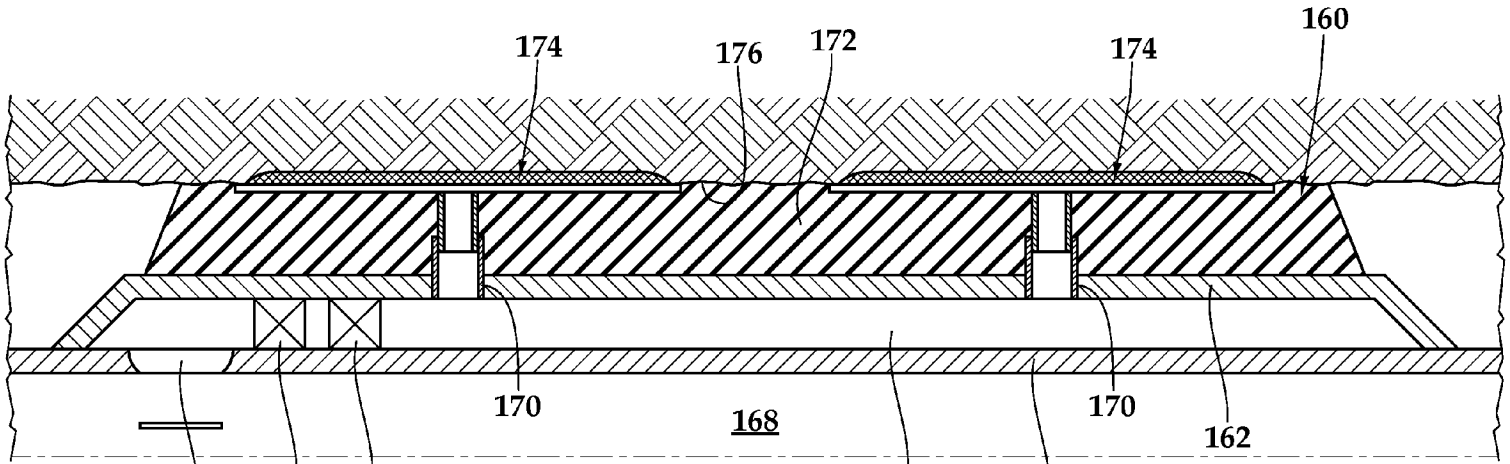
FIG. 9B is a cross sectional view of a sand control screen assembly in an operating configuration according to an embodiment of the present invention.

Referring next to FIG. 9A, therein is depicted a sand control screen assembly in its running configuration that embodies principles of the present invention and is generally designated 160. Sand control screen assembly 160 includes base pipe 162 and an inner sleeve 164 that includes a plurality of openings 166 and defines an internal flow path 168. Base pipe 162 has a plurality of openings 170. Positioned around base pipe 162 is a swellable material layer 172. Swellable material layer 172 is attached to base pipe 162 by bonding or other suitable technique. Sand control screen assembly 160 includes a plurality of radially extendable filter members 174 that are constructed and operate in the manner described herein and are circumferentially distributed around swellable material layer 172 at a plurality of longitudinal locations. As described above, upon activation of swellable material layer 172, extendable filter members 174 are placed in contact with wellbore 176, as best seen in FIG. 9B.

Disposed between base pipe 162 and sleeve 164 is a pair of fluid flow control devices 178, 180. As described above, depending upon the desired operation, fluid flow control devices 178, 180 may take a variety of forms including in any combination of dissolvable, removable or shearable plugs, a burst disk, a one-way valve, a check valve, a nozzle, a flow tube, an orifice or other flow restrictor, a valve that closes responsive to contact with an undesired fluid and the like. In this embodiment, production through multiple radially extendable filter members 174 is combined in the common annular chamber or manifold 182 defined between base pipe 162 and sleeve 164. This provides the benefit of a uniform draw down being applied across the entire length and circumference of sand control screen assembly 160. If it is desired to have unrestricted flow, in certain embodiments, sleeve 164 is removable by mechanical or chemical means.

Additionally or alternatively, a sliding sleeve (not pictured) may be operably associated with sleeve 164 and openings 166. The sliding sleeve may be disposed internally of sleeve 164 within internal flow path 168 or may preferably be disposed externally of sleeve 164 within annular chamber 182. The sliding sleeve may have an open position wherein fluid flow through openings 166 is allowed and a closed position wherein fluid flow though openings 166 is prevented. In addition, the position of the sliding sleeve may be infinitely variable such that the sliding sleeve may provide a choking function. The sliding sleeve may be operated mechanically, electrically, hydraulically or by other suitable means.

Figure 10A:
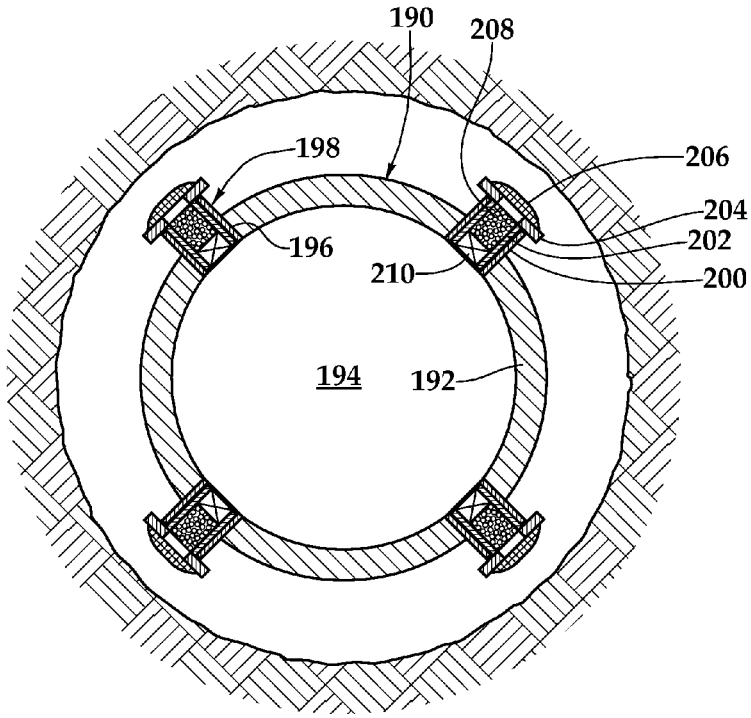
FIG. 10A is a cross sectional view of a sand control screen assembly in a running configuration according to an embodiment of the present invention.

Referring to FIG. 10A, therein is depicted a cross sectional view of a sand control screen assembly in its running configuration that embodies principles of the present invention and is generally designated 190. Sand control screen assembly 190 includes a base pipe 192 that defines an internal flow path 194. Base pipe 192 has a plurality of openings 196 each of which has a radially extendable filter member 198 associated therewith. Preferably, radially extendable filter members 198 are circumferentially and longitudinally distributed about sand control screen assembly 190 to provide a plurality of substantially direct pathways for production fluids from the formation to internal flow path 194 of base pipe 192.

Figure 10B:
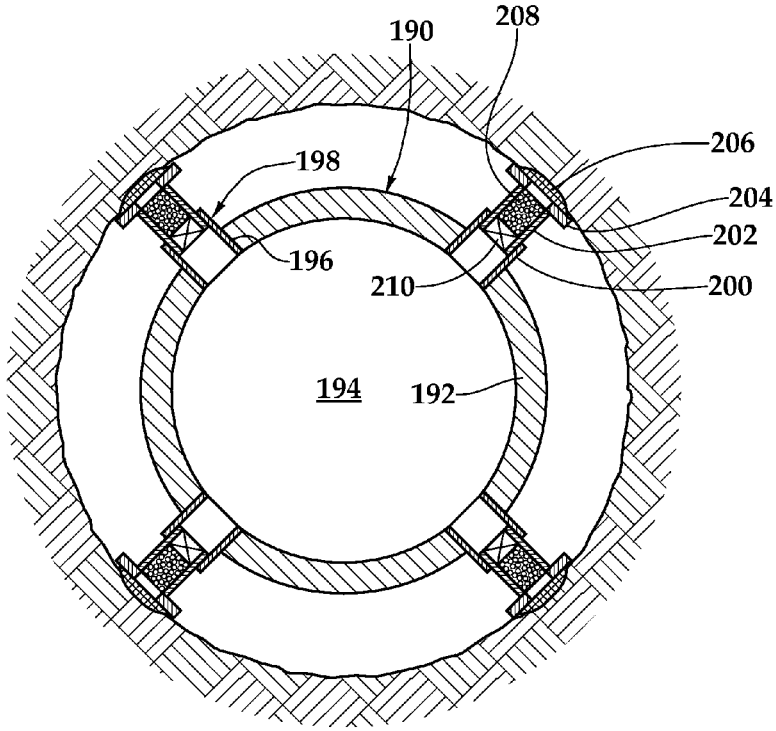
FIG. 10B is a cross sectional view of a sand control screen assembly in an operating configuration according to an embodiment of the present invention.

Radially extendable filter members 198 each includes a cylinder 200 that is attached to base pipe 192 by threading, welding, friction fit or other suitable technique. Slidably positioned within cylinder 200 is a radially telescoping piston 202. Attached to the outer surface of piston 202 is a filter retainer 204. Filter retainer 204 supports an outer filter member 206. As illustrated, outer filter member 206 is a mechanical screening element such as a woven wire or fiber mesh. In addition, disposed within piston 202 is a second screening element 208 such as prepacked or resin coated sand, metallic or ceramic balls or beads that may be sintered or unsintered or the like. Radially extendable filter members 198 also include a fluid flow control device 210. In this embodiment that does not include a swellable material layer, pressure within internal flow path 194 of sand control screen assembly 190 is preferably used to shift radially extendable filter members 198 from their running position to their operating position, as best seen in FIG. 10B. Accordingly, fluid flow control devices 210 are preferably one of dissolvable, removable or shearable plugs, a burst disk, a one-way valve, a check valve, or other device that will allow internal flow path 194 to be pressurize and will also allow production of fluids from the formation, through fluid flow control devices 210 into internal flow path 194.

Figure 11A:
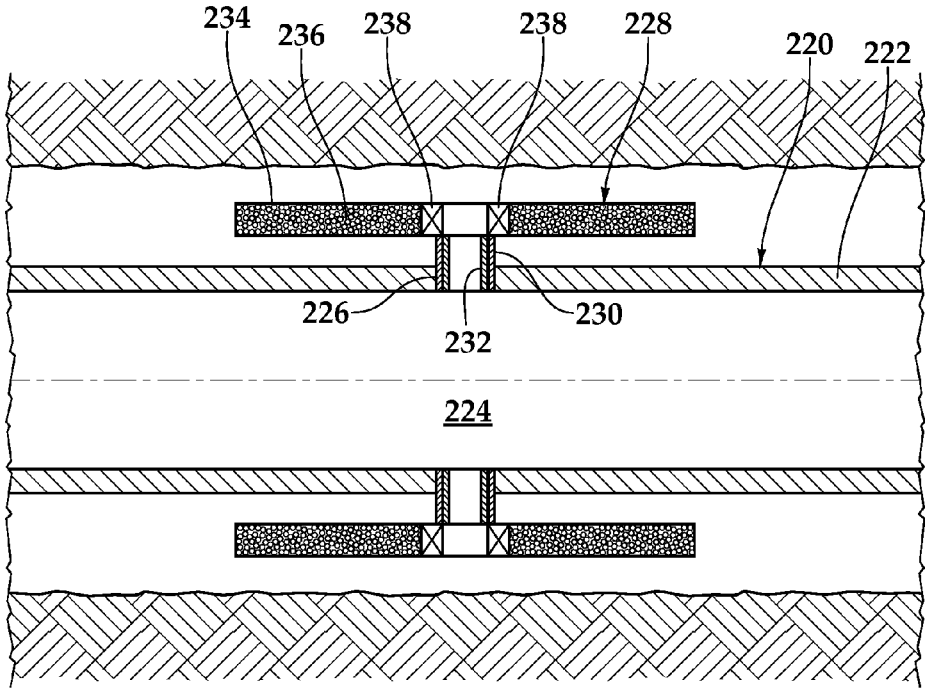
FIG. 11A is a cross sectional view of a sand control screen assembly in a running configuration according to an embodiment of the present invention.

Referring to FIG. 11A, therein is depicted a cross sectional view of a sand control screen assembly in its running configuration that embodies principles of the present invention and is generally designated 220. Sand control screen assembly 220 includes a base pipe 222 that defines an internal flow path 224. Base pipe 222 has a plurality of openings 226 each of which has a radially extendable filter member 228 associated therewith. Prefer ably, radially extendable filter members 228 are circumferentially and longitudinally distributed about sand control screen assembly 220 to provide a plurality of substantially direct pathways for production fluids from the formation to internal flow path 224 of base pipe 222.

Figure 11B:
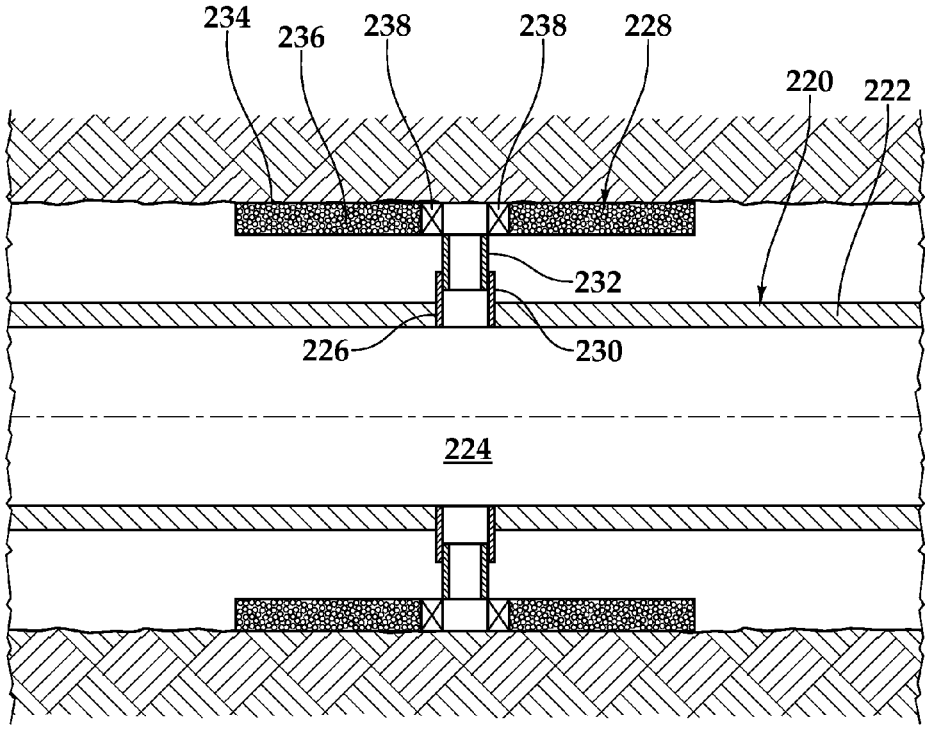
FIG. 11B is a cross sectional view of a sand control screen assembly in an operating configuration according to an embodiment of the present invention.

Radially extendable filter members 228 each includes a cylinder 230 that is attached to base pipe 222 by threading, welding, friction fit or other suitable technique. Slidably positioned within cylinder 230 is a radially telescoping piston 232. Attached to the outer surface of each piston 232 is a longitudinally extending perforated tubular member 234. Disposed within tubular member 234 is a screening element 236 such as prepacked or resin coated sand, metallic or ceramic balls or beads that may be sintered or unsintered or the like. Radially extendable filter members 228 include a pair of fluid flow control devices 238. As this embodiment does not include a swellable material layer, pressure within internal flow path 224 of sand control screen assembly 220 is preferably used to shift radially extendable filter members 228 from their running position to their operating position, as best seen in FIG. 11B. Accordingly, fluid flow control devices 238 are preferably one of dissolvable, removable or shearable plugs, a burst disk, a one-way valve, a check valve, or other devices that will allow internal flow path 224 to be pressurize and will also allow production of fluids from the formation, through fluid flow control devices 238 into internal flow path 224.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly operably positionable within a wellbore, the sand control screen assembly comprising:

a base pipe having a plurality of circumferentially and longitudinally distributed openings in a sidewall portion thereof and an internal flow path;

a swellable material layer disposed exteriorly of the base pipe and having a plurality of openings that correspond to the openings of the base pipe; and a plurality of circumferentially and longitudinally distributed, radially extendable filter members, each radially extendable filter member operably associated with at least one of the openings of the base pipe and at least partially disposed within the corresponding opening of the swellable material layer, the radially extendable filter members having a circumferential dimension that is less than a longitudinal dimension thereof;

wherein, in response to contact with an activating fluid, radial expansion of the swellable material layer causes the radially extendable filter members to shift from a radially retracted running configuration to a radially extended operating configuration.

2. The sand control screen assembly as recited in claim 1 wherein the activating fluid is at least one of a hydrocarbon fluid, water and gas.

3. The sand control screen assembly as recited in claim 1 wherein the radially extendable filter members further comprise a cylinder that is coupled to the base pipe and a radially telescoping piston slidably received within the cylinder.

4. The sand control screen assembly as recited in claim 3 wherein the radially extendable filter members further comprise a filter retainer and filter medium.

5. The sand control screen assembly as recited in claim 3 wherein the radially extendable filter members further comprise a perforated tubular.

6. The sand control screen assembly as recited in claim 1 wherein the ratio between the circumferential dimension and the longitudinal dimension of the radially extendable filter members is at least 1 to 2.

7. The sand control screen assembly as recited in claim 1 wherein the ratio between the circumferential dimension and the longitudinal dimension of the radially extendable filter members is between about 1 to 2 and about 1 to 10.

8. The sand control screen assembly as recited in claim 1 wherein the ratio between the circumferential dimension and the longitudinal dimension of the radially extendable filter members is between about 1 to 10 and about 1 to 30.

9. The sand control screen assembly as recited in claim 1 further comprising a fluid flow control device operably associated with each of the radially extendable filter members.

10. The sand control screen assembly as recited in claim 1 further comprising a fluid flow control device operably associated with a plurality of the radially extendable filter members.

11. The sand control screen assembly as recited in claim 1 wherein a filter medium associated with the radially extendable filter members comprises at least one of a single layer mesh screen, a multiple layer mesh screen, a wire wrapped screen, a prepack screen, a ceramic screen, a fluid porous, particulate resistant sintered wire mesh screen and a fluid porous, particulate resistant diffusion bonded wire mesh screen.

12. The sand control screen assembly as recited in claim 1 wherein, in the radially extended operating configuration, the radially extendable filter members contact the wellbore.

13. A sand control screen assembly operably positionable within a wellbore, the sand control screen assembly comprising:

a base pipe having a plurality of circumferentially and longitudinally distributed openings in a sidewall portion thereof and an internal flow path;

a plurality of circumferentially and longitudinally distributed, radially extendable filter members, each radially extendable filter member operably associated with at least one of the openings of the base pipe, the radially extendable filter members having a circumferential dimension that is less than a longitudinal dimension thereof; and a swellable material layer disposed exteriorly of the base pipe;

wherein, in response to contact with an activating fluid, radial expansion of the swellable material layer causes at least a portion of the radially extendable filter members to be displaced toward a surface of the wellbore.

14. The sand control screen assembly as recited in claim 13 wherein the activating fluid is at least one of a hydrocarbon fluid, water and gas.

15. The sand control screen assembly as recited in claim 13 wherein the ratio between the circumferential dimension and the longitudinal dimension of the radially extendable filter members is at least 1 to 2.

16. The sand control screen assembly as recited in claim 13 wherein the ratio between the circumferential dimension and the longitudinal dimension of the radially extendable filter members is between about 1 to 2 and about 1 to 10.

17. The sand control screen assembly as recited in claim 13 wherein the ratio between the circumferential dimension and the longitudinal dimension of the radially extendable filter members is between about 1 to 10 and about 1 to 30.

18. The sand control screen assembly as recited in claim 13 further comprising a fluid flow control device operably associated with each of the radially extendable filter members.

19. The sand control screen assembly as recited in claim 13 further comprising a fluid flow control device operably associated with a plurality of the radially extendable filter members.

20. The sand control screen assembly as recited in claim 13 wherein a filter medium associated with the radially extendable filter members comprises at least one of a single layer mesh screen, a multiple layer mesh screen, a wire wrapped screen, a prepack screen, a ceramic screen, a fluid porous, particulate resistant sintered wire mesh screen and a fluid porous, particulate resistant diffusion bonded wire mesh screen.

21. The sand control screen assembly as recited in claim 13 wherein, in response to contact with an activating fluid, radial expansion of the swellable material layer causes at least a portion of the radially extendable filter members to contact the wellbore.

22. A method of installing a sand control screen assembly in a wellbore, the method comprising:

running the sand control screen assembly to a target location within the wellbore;

contacting a swellable material layer disposed exteriorly on a base pipe with an activating fluid, the swellable material layer and the base pipe having corresponding openings;

radially expanding the swellable material layer in response to contact with the activating fluid; and operating a plurality of circumferentially and longitudinally distributed, radially extendable filter members from a radially retracted running configuration to a radially extended operating configuration in response to the radial expansion of the swellable material layer, the radially extendable filter members having a circumferential dimension that is less than a longitudinal dimension thereof and each of the radially extendable filter members operably associated with at least one opening of the base pipe and the swellable material layer.

23. The method as recited in claim 22 wherein contacting a swellable material layer disposed exteriorly on a base pipe with an activating fluid further comprises contacting the swellable material layer with at least one of a hydrocarbon fluid and water.

24. The method as recited in claim 22 wherein operating a plurality of circumferentially and longitudinally distributed radially extendable filter members from a radially retracted running configuration to a radially extended operating configuration further comprises placing at least a portion of the radially extendable filter members in contact with the wellbore.

25. A sand control screen assembly operably positionable within a wellbore, the sand control screen assembly comprising:

a first tubular having a plurality of openings in a sidewall portion thereof;

a second tubular disposed within the first tubular forming an chamber therebetween, the second tubular having at least one opening in a sidewall portion thereof and an internal flow path;

a plurality of radially extendable filter members, each radially extendable filter member operably associated with at least one of the openings of the first tubular; and a swellable material layer disposed exteriorly of the first tubular;

wherein, in response to contact with an activating fluid, radial expansion of the swellable material layer causes at least a portion of the radially extendable filter members to be displaced toward a surface of the wellbore.

26. The sand control screen assembly as recited in claim 25 wherein the activating fluid is at least one of a hydrocarbon fluid, water and gas.

27. The sand control screen assembly as recited in claim 25 wherein the chamber formed between the first and second tubulars is an annular chamber.

28. The sand control screen assembly as recited in claim 25 further comprising a fluid flow control device disposed in the chamber formed between the first and second tubulars.

29. The sand control screen assembly as recited in claim 28 wherein the fluid flow control device is selected from dissolvable plugs, removable plugs, shearable plugs, burst disks, one-way valves, check valves, nozzles, flow tubes, orifices, flow restrictors and valves that closes responsive to contact with an undesired fluid.

30. The sand control screen assembly as recited in claim 25 further comprising a pair of fluid flow control devices disposed in series within the chamber formed between the first and second tubulars.

31. The sand control screen assembly as recited in claim 30 wherein each of the fluid flow control devices is selected from dissolvable plugs, removable plugs, shearable plugs, burst disks, one-way valves, check valves, nozzles, flow tubes, orifices, flow restrictors and valves that closes responsive to contact with an undesired fluid.

32. The sand control screen assembly as recited in claim 25 wherein a filter medium associated with the radially extendable filter members comprises at least one of a single layer mesh screen, a multiple layer mesh screen, a wire wrapped screen, a prepack screen, a ceramic screen, a fluid porous, particulate resistant sintered wire mesh screen and a fluid porous, particulate resistant diffusion bonded wire mesh screen.

33. The sand control screen assembly as recited in claim 25 wherein, in response to contact with an activating fluid, radial expansion of the swellable material layer causes at least a portion of the radially extendable filter members to contact the wellbore.

34. The sand control screen assembly as recited in claim 25 wherein the second tubular is removable.

35. The sand control screen assembly as recited in claim 25 wherein the radially extendable filter members are circumferentially and longitudinally distributed about the first tubular.

36. The sand control screen assembly as recited in claim 25 wherein the radially extendable filter members have a circumferential dimension that is less than a longitudinal dimension thereof.

* * * * *